US009236662B2

(12) United States Patent
Jang et al.

(10) Patent No.: US 9,236,662 B2
(45) Date of Patent: Jan. 12, 2016

(54) TERMINAL INCLUDING A PLURALITY OF ANTENNAS

(71) Applicant: Samsung Electronics Co. Ltd., Suwon-si, Gyeonggi-do (KR)

(72) Inventors: Dongoh Jang, Seongnam-si (KR); Seoyoung Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 388 days.

(21) Appl. No.: 13/749,216

(22) Filed: Jan. 24, 2013

(65) Prior Publication Data

US 2013/0257675 A1 Oct. 3, 2013

(30) Foreign Application Priority Data

Apr. 2, 2012 (KR) ..... 10-2012-0033831

(51) Int. Cl.

| | |
|---|---|
| ***H01Q 1/24*** | (2006.01) |
| ***H01Q 21/00*** | (2006.01) |
| ***H01Q 7/00*** | (2006.01) |
| ***H01Q 1/50*** | (2006.01) |
| *H01Q 21/28* | (2006.01) |

(52) U.S. Cl.

CPC ..... *H01Q 21/00* (2013.01); *H01Q 1/243* (2013.01); *H01Q 1/50* (2013.01); *H01Q 7/00* (2013.01); *H01Q 21/28* (2013.01)

(58) Field of Classification Search

USPC ..... 343/702, 853, 866, 867

See application file for complete search history.

(56) References Cited

U.S. PATENT DOCUMENTS

| | | | | |
|---|---|---|---|---|
| 6,154,177 | A * | 11/2000 | Saito et al. | 343/702 |
| 2004/0105040 | A1 * | 6/2004 | Oh et al. | 349/12 |
| 2012/0086661 | A1 * | 4/2012 | Shi et al. | 345/173 |

* cited by examiner

*Primary Examiner* — Tan Ho

(74) *Attorney, Agent, or Firm* — Jefferson IP Law, LLP

(57) ABSTRACT

A terminal for performing at least one of wired and wireless communication is provided. The terminal includes a first antenna configured to recognize a handwriting through a change of an electromagnetic field and a second antenna for a short range wireless communication, wherein the first antenna and the second antenna are formed on a same Flexible Printed Circuit Board (FPCB).

21 Claims, 6 Drawing Sheets

TERMINAL INCLUDING A PLURALITY OF ANTENNAS

PRIORITY

This application claims the benefit under 35 U.S.C. §119 (a) of a Korean patent application filed on Apr. 2, 2012 in the Korean Intellectual Property Office and assigned Serial No. 10-2012-0033831, the entire disclosure of which is hereby incorporated by reference.

BACKGROUND OF THE INVENTION

1. Field of the Invention

The present invention relates to a terminal having a plurality of antennas. More specifically, the present invention relates to a terminal having a plurality of antennas and having improved communication performance by virtue of an arrangement of the plurality of the antennas.

2. Description of the Related Art

A plurality of terminals, which communicate by using different frequencies, require different antennas. Here, for arranging the different antennas, the antennas are arranged on at least one of an outside of the terminal, an internal frame of the terminal, an outer battery case, and a surface of a battery. In this case, it is disadvantageous in that, by mounting each antenna, a cost for mounting the antenna is increased and a volume of the terminal is increased. In particular, in a radio communication method in which data is transmitted, received, and recorded without using an external power supply by using electromagnetic induction, an antenna loop having a wide area is needed, and thus, it is difficult to provide an antenna having a wide area if the terminal has a limited volume.

Therefore, a need exists for a terminal having a plurality of antennas without increasing a volume thereof.

SUMMARY OF THE INVENTION

Aspects of the present invention are to address at least the above-mentioned problems and/or disadvantages and to provide at least the advantages described below. Accordingly, an aspect of the present invention is to provide a terminal having a plurality of antennas and a compact size by virtue of a mounting structure of the antennas.

In accordance with an aspect of the present invention, a terminal for performing at least one of wired and wireless communication is provided. The terminal includes an antenna unit including a first antenna and a second antenna, the first antenna configured to at least one of transmit and receive information via a first frequency band, the second antenna configured to at least one of transmit and receive information via a second frequency band, the first frequency band being different than the second frequency band, wherein the first antenna at least one of transmits and receives communication information through an electromagnetic interaction with the terminal and the second antenna at least one of transmits and receives radio frequency identification information, and wherein the antenna unit is formed on a same circuit board.

In accordance with another aspect of the present invention, a terminal for performing at least one of wired and wireless communication is provided. The terminal includes a first antenna configured to recognize a handwriting through a change of an electromagnetic field, and a second antenna for a short range wireless radio communication, wherein the first antenna and the second antenna are formed on a same Flexible Printed Circuit Board (FPCB).

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1A:
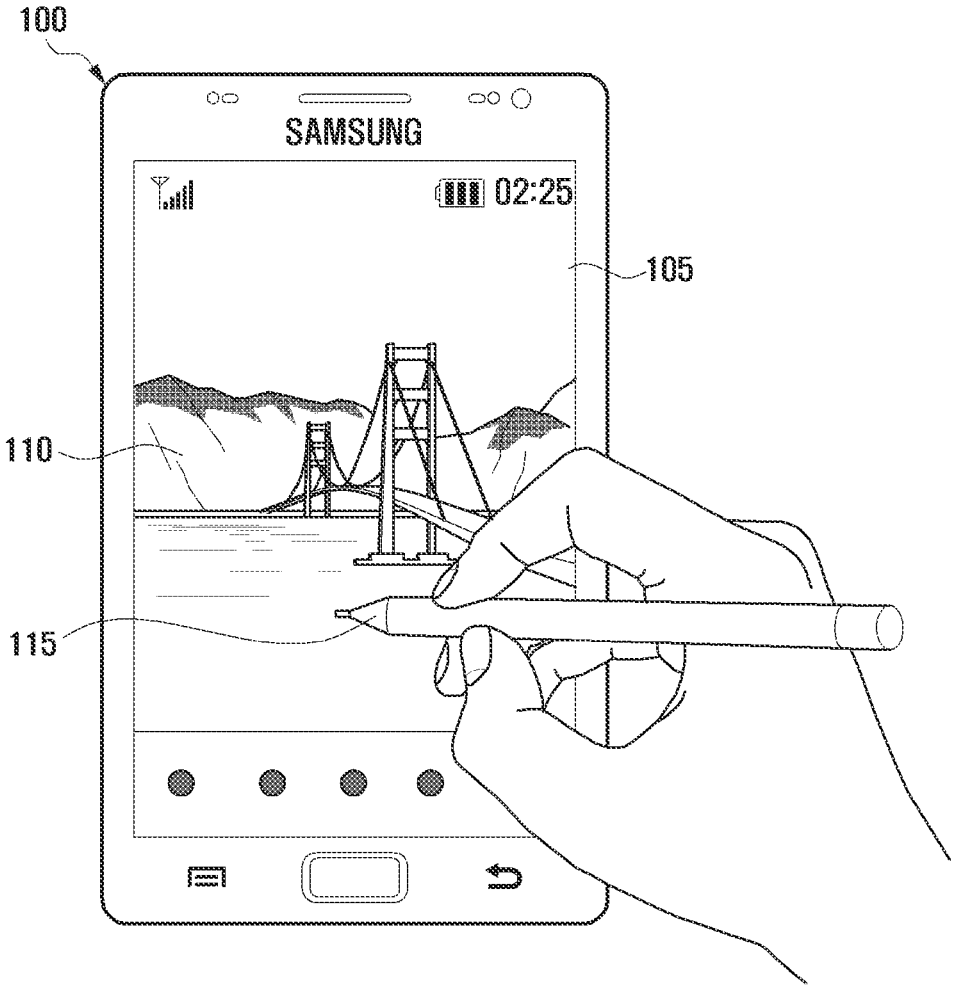
FIG. 1A is a view illustrating a handwriting input to a terminal according to an exemplary embodiment of the present invention.
Figure 1B:
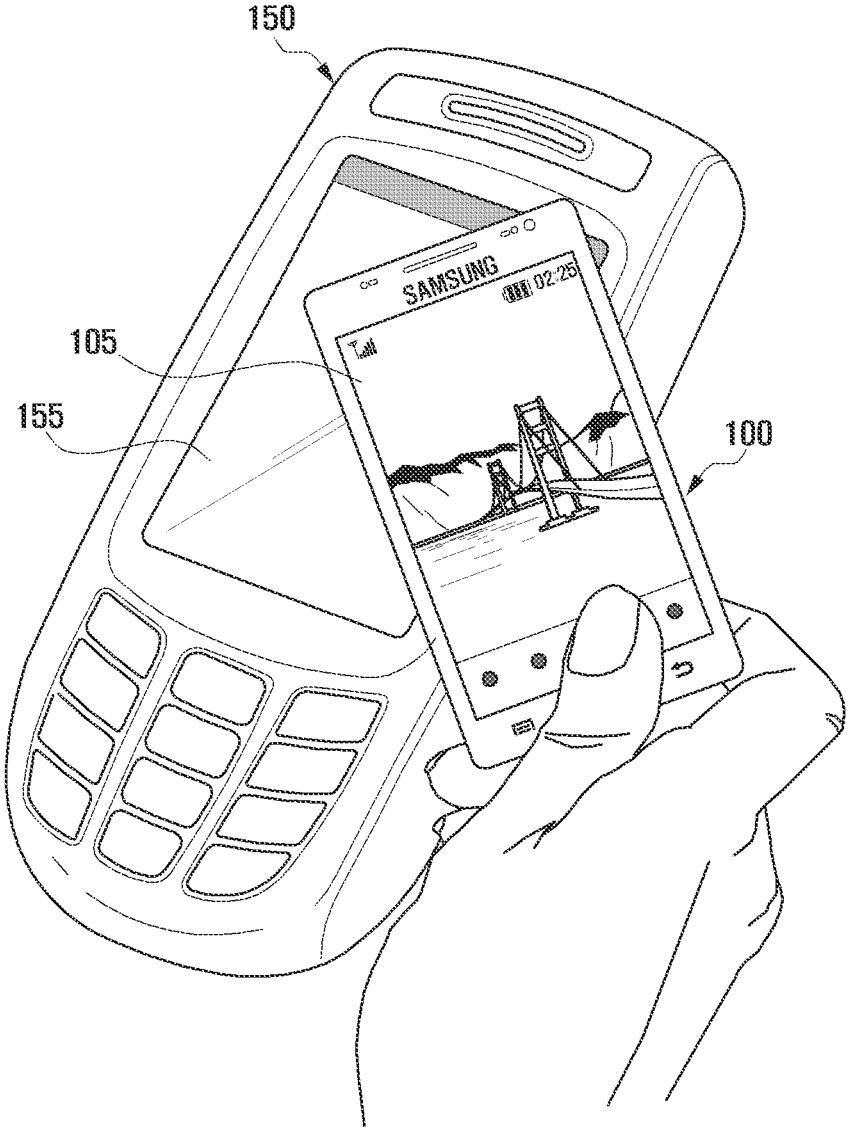
FIG. 1B is a view illustrating transmission and reception of radio frequency identification information of a terminal according to an exemplary embodiment of the present invention.

FIG. 1A is a view illustrating a handwriting input to a terminal according to an exemplary embodiment of the present invention, and FIG. 1B is a view illustrating transmission and reception of radio frequency identification information of a terminal according to an exemplary embodiment of the present invention.

Referring to FIGS. 1A and 1B, a terminal 100 may include a display unit 105 for displaying an operation of the terminal 100. The display unit 105 may correspond to the display unit 260 of FIG. 2 and/or the display unit 420 of FIG. 4. The display unit 105 may be implemented by using a commercial device such as a Liquid Crystal Display (LCD) or an Active Matrix Organic Light Emitting Diode (AM OLED).

The terminal 100 may include an antenna unit used for recognizing handwriting. When a pen type transmitter 115 contacts the terminal 100, the handwriting recognition may be performed by recognizing an intensity and movement of the contact. The pen type transmitter 115 may correspond to the pen type transmitter 405 of FIG. 4. The pen type transmitter 115 is equipped with a device that can generate an electric field or an electromagnetic field and the antenna unit provided within the terminal 100 may recognize a change in the electric field or the electromagnetic field to recognize the intensity or movement of the contact when the pen type transmitter 115 contacts the terminal 100.

The terminal 100 may recognize a touch input from a user by using the pen type transmitter 115 and may draw a drawing 110 according to an input by the user. The terminal 100 may operate in such a manner that brightness is varied according to a recognized intensity of the contact when the pen type transmitter 115 contacts the terminal 100 or different operations are distinguished based on an input intensity. In another exemplary embodiment, the drawing may be deleted according to a contact of the same intensity by changing the electromagnetic field of the pen type transmitter 115 or different colors may be inputted according to a change of the electromagnetic field.

Also, the terminal 100 may transmit and receive radio frequency identification. The radio frequency identification enables transmission and reception of data through a short range wireless communication. When the terminal 100 approaches a transmission and reception enabling unit 155 of an external transmission and reception device 150, data may be transmitted and received between the terminal 100 and the transmitting and receiving device 150 through the wireless communication.

A method of transmitting the radio frequency identification information may use at least one of a low frequency band (e.g., 125 KHz band), a high frequency band (e.g., 13 MHz band), an ultra high frequency band (e.g., 43.92 MHz, 860 MHz, or 960 MHz band) and a microwave band (e.g., 2.45 GHz band). Also, the method of transmitting the radio frequency identification information may include a passive type of transmitter/receiver that does not use a separate external power supply and an active type of transmitter/receiver that uses a separate external power supply.

In order to transmit and receive the radio frequency identification information, the terminal 100 uses a separate antenna unit.

Figure 2:
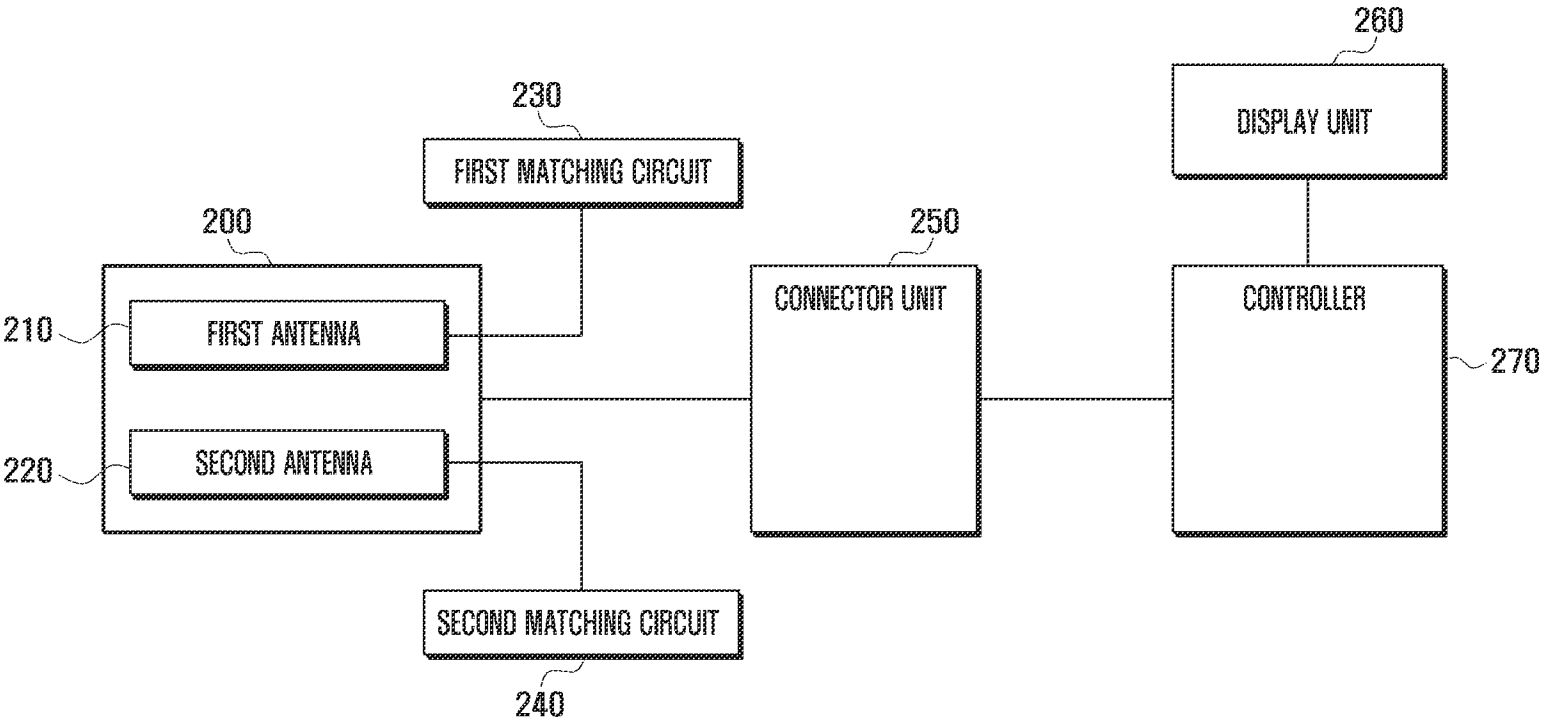
FIG. 2 is a block diagram illustrating a configuration of a terminal according to an exemplary embodiment of the present invention.

FIG. 2 is a block diagram illustrating a configuration of a terminal according to an exemplary embodiment of the present invention.

Referring to FIG. 2, the terminal may include an antenna unit 200 including a first antenna 210 and a second antenna 220. The first antenna 210 may correspond to the first antennas 310, 315, 320, and 325 of FIG. 3 and/or the first antenna 450 of FIG. 4. The second antenna 220 may correspond to the second antenna 330 of FIG. 3 and/or the second antenna 460 of FIG. 4.

The first antenna 210 may transmit and receive communication information through an electromagnetic interaction with the terminal. In an exemplary embodiment of the present invention, a communication method for transmitting information through the electromagnetic interaction may include a method of using a digitizer and a tablet. The digitizer and the tablet may receive a user input by using a pen type transmitter (e.g., the pen type transmitter 115 of FIG. 1 and/or the pen type transmitter 405 of FIG. 4) that transmits an electromagnetic wave in a band of less than 1 MHz, preferably 500 KHz. When the pen type transmitter contacts the terminal and moves, the first antenna 210 receives a changing electromagnetic field and recognizes a touch input of a pen by the corresponding change of the electromagnetic field. The first antenna 210 may include a plurality of antennas in a loop shape. The plurality of antennas in the loop shape may be arranged on an entire area of the terminal to recognize a touch input on the terminal through the pen type transmitter.

The terminal may include a first matching circuit 230 that is connected to the first antenna 210 so as to receive an electromagnetic signal received in the first antenna 210 without loss. The first matching circuit 230 may enable the electromagnetic signal to be transmitted and received without loss through the first antenna 210 through impedance matching.

The terminal may transmit and receive the radio frequency identification information through the second antenna 220. The radio frequency identification information may be transmitted and received between remote terminals by using a frequency of a particular band.

In an exemplary embodiment of the present invention, the second antenna 220 may be an antenna that supports a Near Field Communication (NFC). The NFC can transmit and receive information within a distance of 1M by using a high frequency component in a 13.56 MHz band, and one of the terminals participating in the communication can be a passive type of transmitter/receiver that does not require a local power source. Therefore, in order to receive power using an electromagnetic wave, the second antenna 220 according to an exemplary embodiment of the present invention should occupy a sufficient area. Through the NFC, one or more of payment, baggage management, exit and entry control, security management, etc., can be performed.

The terminal may include a second matching circuit 240 that is connected to the second antenna 220 so as to receive the electromagnetic signal received in the second antenna 220 without loss. The second matching circuit 240 may enable transmission and reception of the electromagnetic signal without loss through the second antenna 220 through impedance matching.

The first antenna 210 and the second antenna 220 may be included in the antenna unit 200, and the antenna unit 200 may be formed in one circuit board. By forming the first antenna 210 and the second antenna 220 on one circuit board, an overall size of the terminal may not need to be increased. Also, in an exemplary embodiment of the present invention, the circuit board may be a Flexible Printed Circuit Board (FPCB). By arranging the antenna unit 200 on the flexible printed circuit board, it is advantageous in that a three dimensional wiring is possible, durability against bending is achieved, a high density wiring in a small area is possible, and a continuous production is possible. Therefore, in an exemplary embodiment of the present invention, by arranging the first antenna unit 210 on the flexible printed circuit board, an effect of arranging a plurality of antennas in the loop shape on one circuit board is achieved.

The antenna unit 200 may be connected to the controller 270 through the connector unit 250. The connector unit 250 may correspond to the connector unit 500 of FIG. 5. The connector unit 250 transmits a plurality of signals received from the first antenna 210 including a plurality of loop-shaped antennas and a signal received from the second antenna 220 to the controller 270. At least one of the first matching circuit 230 and the second matching circuit 240 may be positioned between the antenna unit 200 and the connector unit 250.

The connector unit 250 may be separately configured such that a plurality of signals received from the antenna unit 200 is effectively transmitted to the controller 270.

The terminal may further include a display unit 260 for displaying an operational condition of the terminal. The display unit 260 may correspond to the display unit 105 of FIG. 1 and/or the display unit 420 of FIG. 4. The display unit 260 may display the operational condition of the terminal according to a control of the controller 270.

According to an exemplary embodiment of the present invention, the controller 270 may display on the display unit 260 whether data is transmitted or received to/from the first antenna 210 and/or whether data is transmitted or received to/from the second antenna 220. By displaying an antenna being used on the display unit 260, a user may be made aware of what type of data communication is currently being performed.

Figure 3:
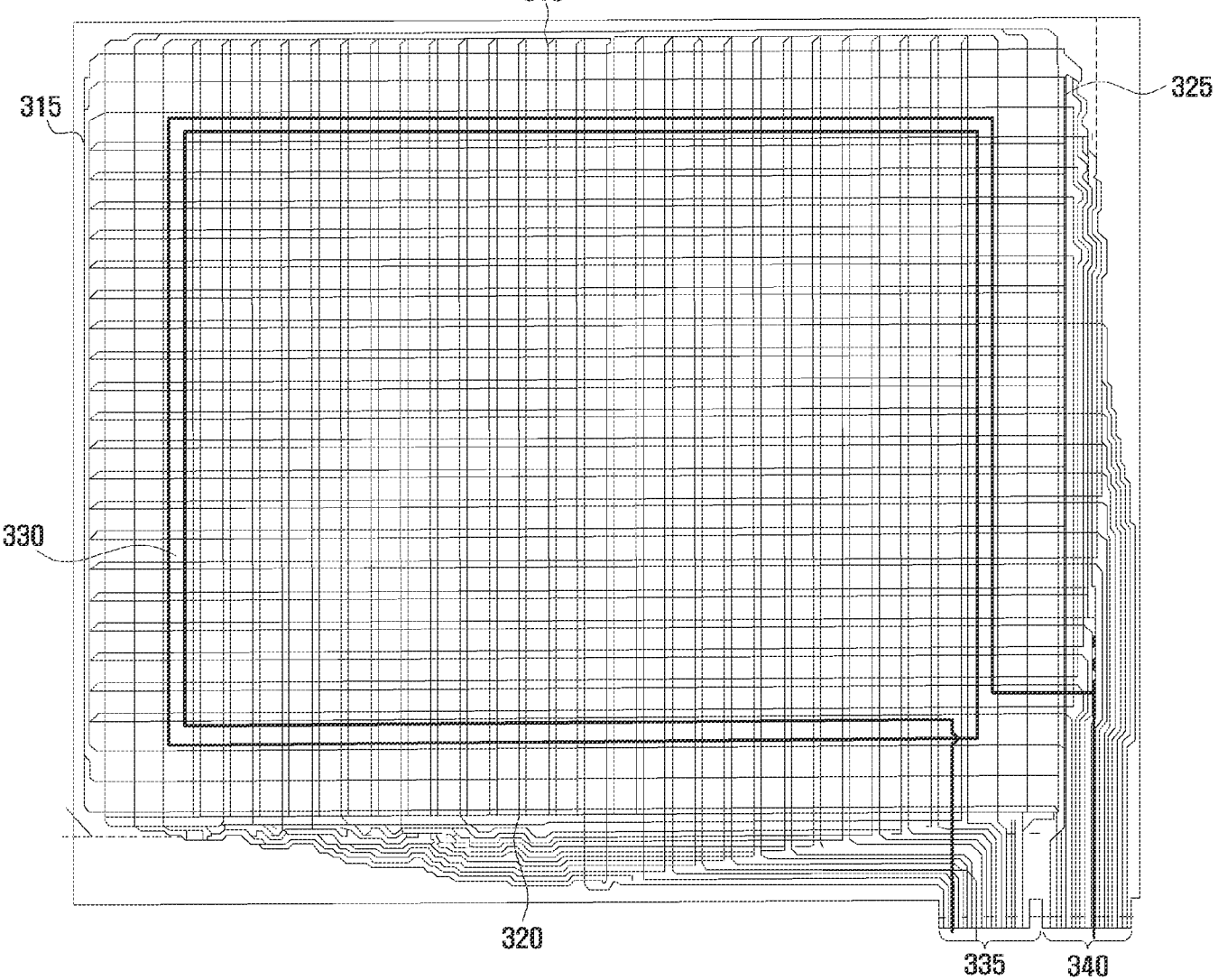
FIG. 3 is a view illustrating an antenna unit of a terminal according to an exemplary embodiment of the present invention.

FIG. 3 is a view illustrating an antenna unit of a terminal according to an exemplary embodiment of the present invention.

Referring to FIG. 3, the antenna unit may include first antennas 310, 315, 320, and 325, and a second antenna 330. The first antennas 310, 315, 320, and 325 may collectively correspond to first antenna 210 of FIG. 2 and/or the first antenna 450 of FIG. 4. The second antenna 330 may correspond to second antenna 220 of FIG. 2 and/or the second antenna 460 of FIG. 4.

The first antenna may include a horizontal arrangement antenna 310, a vertical arrangement antenna 315, and grounded antennas 320 and 325. Thus, the first antenna includes a plurality of loop-shaped antennas. By placing the plurality of loop-shaped antennas on a plane, when the electromagnetic interaction occurs, a location and intensity of the electromagnetic interaction and a change thereof may be recognized.

The second antenna 330 may be arranged in a shape of a loop including multiple antennas among the loop-shaped antennas included in the first antenna. The second antenna 330 can be formed by multiple windings to secure sufficient energy because the second antenna 330 needs to receive a power by using the electromagnetic wave from an external transmitting and receiving terminal when transmitting and receiving the radio frequency identification information. In an exemplary embodiment of the present invention, the second antenna 330 may be formed as an antenna having a size of 40~60 mm×40~60 mm and have three or more windings. By securing a sufficient antenna area, communication performance may be improved. In the related art, the antenna unit is formed on a battery mounting unit or the battery of the terminal so that an exterior appearance of the terminal is not appealing and an antenna having a plurality of loops needs to be used in order to secure a sufficient antenna area.

Wiring of the first antenna and the second antenna 330 may be connected to the connector unit (e.g. the connector unit 250 of FIG. 2 and/or the connector unit 500 of FIG. 5) through wiring concentration units 335 and 340. Thus, by forming the antenna unit having a plurality of antennas on one board, a volume of the terminal may be reduced.

Figure 4:
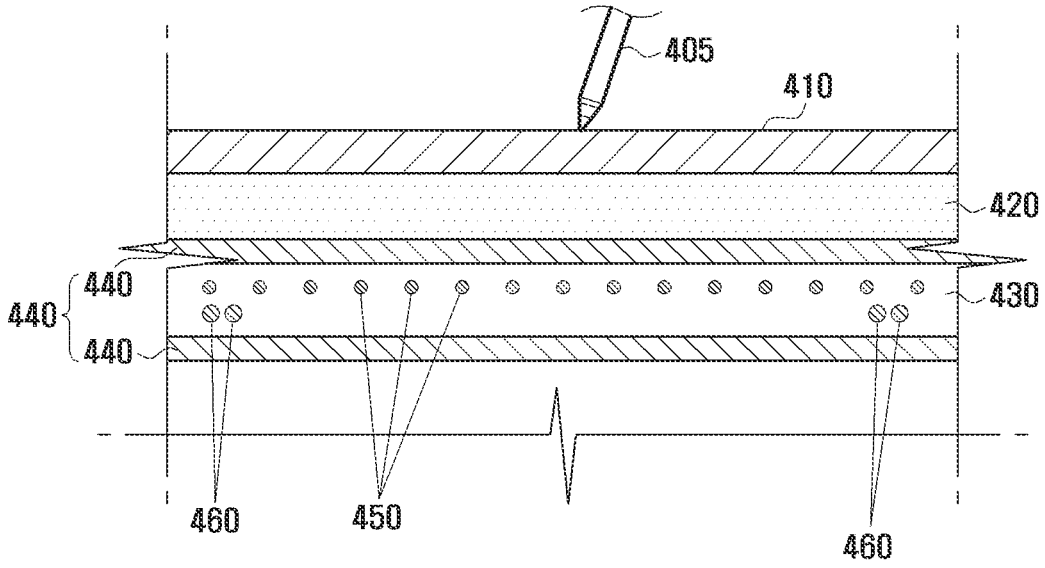
FIG. 4 is a side cross sectional view illustrating a terminal according to an exemplary embodiment of the present invention.

FIG. 4 is a side cross sectional view illustrating a terminal according to an exemplary embodiment of the present invention.

Referring to FIG. 4, the terminal may receive an input from a pen type transmitter 405 and include a protection layer 410 for protecting the terminal from an external shock. The pen type transmitter 405 may correspond to the pen type transmitter 115 of FIG. 1. In one exemplary embodiment, the protection layer 410 may be tempered glass.

A display unit 420 may be disposed adjacent to the protection layer 410. The display unit 420 may correspond to the display unit 105 of FIG. 1 and/or the display unit 260 of FIG. 2. The display unit 420 may be a commercial display device such as the LCD or AM OLED.

An antenna unit 430 may be disposed adjacent to the display unit 420. The antenna unit 430 may be disposed adjacent to the display unit 420 as shown in the drawings or may be disposed separate from the display unit 420 according to an alternative exemplary embodiment. The antenna unit 430 may include a first antenna 450 and a second antenna 460. The first antenna 450 may correspond to the first antenna 210 of FIG. 2 and/or the first antennas 310, 315, 320, and 325 of FIG. 3. The second antenna 460 may correspond to the second antenna 220 of FIG. 2 and/or the second antenna 330 of FIG. 3. The first antenna 450 is an antenna that can transmit or receive communication information through electromagnetic interaction with the terminal. Also, the second antenna 460 is an antenna that can transmit or receive radio frequency identification information. The first antenna 450 may be positioned closer to the display unit 420 compared to the second antenna 460, as shown in FIG. 4. Through this positioning, the terminal may respond to an input from the pen type transmitter 405 more sensitively. Also, when transmitting or receiving the radio frequency identification information by using the second antenna 460, the user may easily identify a result of the transmission or reception of the radio information through the display unit 420.

The antenna unit 430 may further include an absorber unit 440 that can be positioned on a surface thereof. The absorber unit 440 may block a noise component in the electromagnetic wave transmitted or received from/to the antenna unit 430, thereby increasing communication efficiency. In one exemplary embodiment, a component of the absorber unit 440 may be ferrite.

Thus, by arranging a plurality of antennas in one antenna unit 430, only a pair of absorber units 440 is included, thereby achieving an effect of reducing a volume of the terminal.

Figure 5:
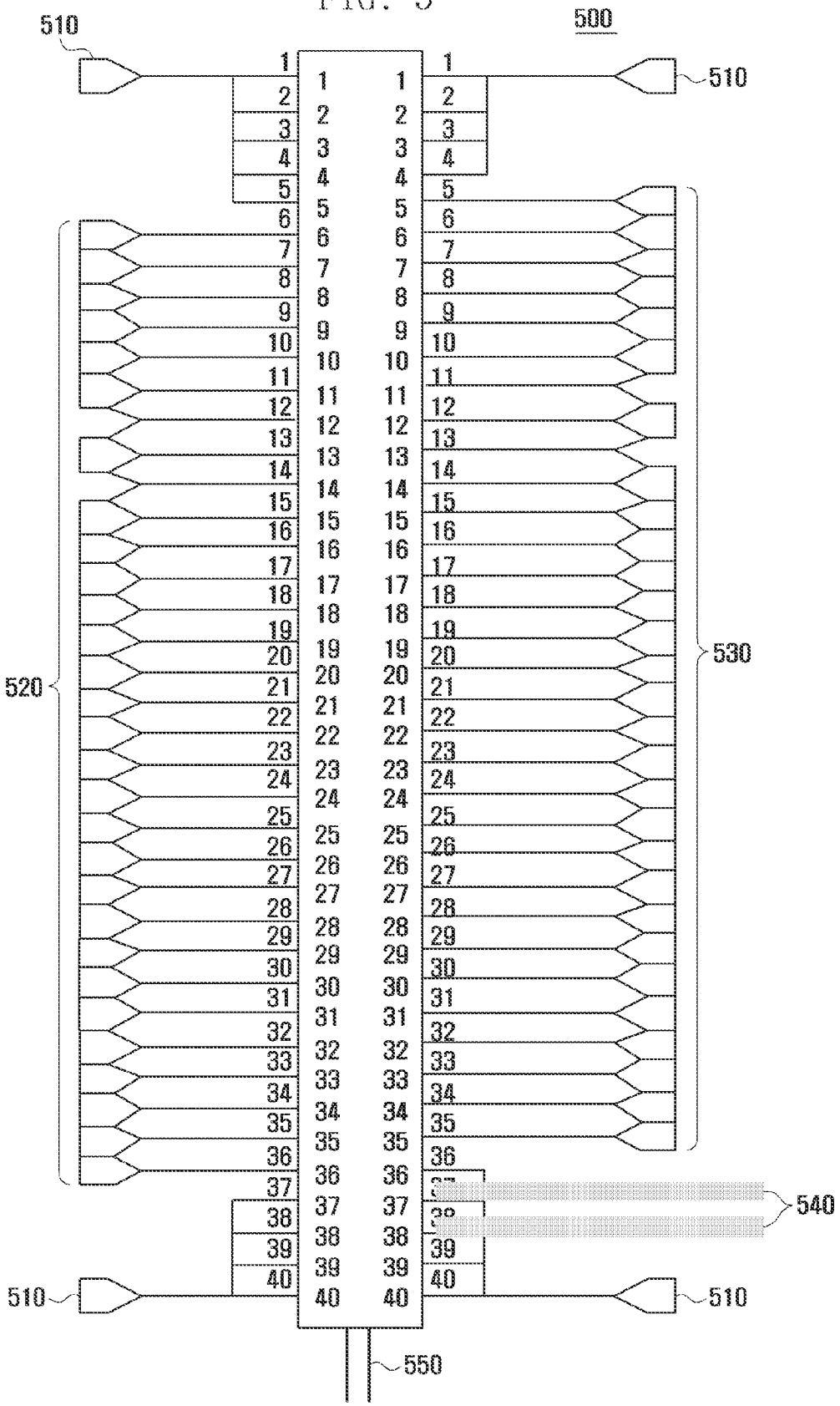
FIG. 5 is a view illustrating a connector unit of a terminal according to an exemplary embodiment of the present invention.

FIG. 5 is a view illustrating a connector unit of a terminal according to an exemplary embodiment of the present invention.

A connector unit 500 may include one or more power input units 510 for supplying a reference power. A required power may be provided to the antenna unit through the power input unit 510. The connector unit 500 may correspond to connector unit 250 of FIG. 2.

Also, the connector unit 500 may include first signal input units 520, 530 connected to the wiring concentration units 335, 340 of the FIG. 3. The signal input units may be connected with the first antenna (e.g., the first antenna 210 of FIG. 2, the first antennas 310, 315, 320, and 325 of FIG. 3, and/or the first antenna 450 of FIG. 4). The first antenna may include a plurality of loop-shaped antennas and recognize an input signal through wiring corresponding to each position of a horizontally arranged antenna or a vertically arranged antenna that may receive an input.

In an exemplary embodiment of the present invention, the first signal input unit 520 positioned on a left side may receive a signal used for detecting movement in a horizontal direction and the first input unit 530 on a right side may receive a signal used for detecting movement in a vertical direction.

Also, the connector unit 500 may further include a second signal input unit 540 connected to the second antenna (e.g., the second antenna 220 of FIG. 2, the second antenna 330 of FIG. 3, and/or the second antenna 460 of FIG. 4). A radio frequency identification information signal transmitted or received to/from the second antenna unit may be inputted or outputted to/from the second signal input unit 540.

Thus, by connecting a signal connected to the first antenna and the second antenna to the controller in one attempt through the connector unit 500, an effect of reducing a volume of an entire terminal may be achieved.

In a terminal capable of performing wired or wireless communication and including a plurality of antennas, communication performance may be improved by controlling an arrangement of antennas. Also, since a separate mounting structure is not needed, a manufacturing cost may be reduced, and the antenna arrangement may be facilitated by providing an antenna having a sufficient communication area.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A terminal for performing at least one of wired and wireless communication, the terminal comprising:

an antenna unit including a circuit board, a first antenna formed near a first side of the circuit board and a second antenna formed near a second side of the circuit board, the first antenna configured to at least one of transmit and receive information via a first frequency band, the second antenna configured to at least one of transmit and receive information via a second frequency band, the first frequency band being different than the second frequency band; and a display unit configured to display information including operation information of the terminal, the display unit being adjacent to the first side of the circuit board, wherein the first antenna at least one of transmits and receives communication information through an electromagnetic interaction with the terminal and the second antenna at least one of transmits and receives radio frequency identification information, and wherein the first antenna and the second antenna are separate from each other.

2. The terminal of claim 1, further comprising:

a controller configured to control an operation of the terminal, wherein the first antenna and the second antenna are connected to the controller through a same connector unit.

3. The terminal of claim 1, wherein the first antenna at least one of transmits and receives information about a change in an induced electromotive force.

4. The terminal of claim 1, wherein the first frequency band is equal to or lower than 1 MHz, and the second frequency band is equal to or higher than 10 MHz.

5. The terminal of claim 1, wherein the first antenna includes a plurality of loop shaped antennas.

6. The terminal of claim 5, wherein the second antenna includes a loop shaped antenna including the plurality of loop shaped antennas included in the first antenna.

7. The terminal of claim 6, wherein the second antenna includes a loop shaped antenna having three or more windings.

8. The terminal of claim 1, further comprising:

a matching circuit connected to at least one of the first antenna and the second antenna, the matching circuit corresponding to at least one of the first frequency band and the second frequency band.

9. The terminal of claim 1, further comprising:

an absorber unit disposed on the circuit board and configured to block a noise component when information is at least one of transmitted and received through at least one of the first antenna and the second antenna.

10. The terminal of claim 1, wherein, when the information is at least one of transmitted and received through at least one of the first antenna and the second antenna, the display unit displays a screen corresponding to information about whether the information is being at least one of transmitted and received and information about at least one of the first antenna and the second antenna.

11. The terminal of claim 10, wherein the first antenna is formed closer to the display unit compared to the second antenna.

12. The terminal of claim 1, wherein the circuit board is a Flexible Printed Circuit Board (FPCB).

13. A terminal for performing at least one of wired and wireless communication, the terminal comprising:

a first antenna formed near a first side of a Flexible Printed Circuit Board (FPCB), the first antenna configured to recognize a-handwriting through a change of an electromagnetic field;

a second antenna formed near a second side of the FPCB, the second antenna configured to receive and to transmit a signal for a short range wireless communication; and a display unit configured to display information including operation information of the terminal, the display unit being adjacent to the first side of the FPCB, wherein the first antenna and the second antenna are separate from each other.

14. The terminal of claim 13, wherein the first antenna is configured to at least one of transmit and receive via a first frequency band, the second antenna configured to at least one of transmit and receive via a second frequency band, the first frequency band being different than the second frequency band.

15. The terminal of claim 14, further comprising:

a matching circuit connected to at least one of the first antenna and the second antenna, the matching circuit corresponding to at least one of the first frequency band and the second frequency band.

16. The terminal of claim 13, further comprising:

a controller configured to control an operation of the terminal, wherein the first antenna and the second antenna are connected to the controller through a same connector unit.

17. The terminal of claim 13, wherein the first antenna includes a plurality of loop shaped antennas.

18. The terminal of claim 13, further comprising:

an absorber unit disposed on the FPCB and configured to block a noise component when at least one of the first antenna and the second antenna at least one of transmits and receives.

19. The terminal of claim 13, wherein, when the information is at least one of transmitted and received through at least one of the first antenna and the second antenna, the display unit displays a screen corresponding to information about whether the information is being at least one of transmitted and received and information about at least one of the first antenna and the second antenna.

20. The terminal of claim 19, wherein the first antenna is formed closer to the display unit compared to the second antenna.

21. A terminal for performing at least one of wired and wireless communication, the terminal comprising:

a display unit configured to display information including operation information of the terminal;

a first antenna unit configured to detect a touch input on the display unit, the first antenna unit including a horizontal arrangement antenna and a vertical arrangement antenna; and a second antenna unit configured to transmit and to receive a signal for near field communication, the second antenna unit including a loop shaped antenna, wherein the first antenna unit and the second antenna unit are formed on a same Flexible Printed Circuit Board (FPCB).

* * * * *